US009241534B2

(12) United States Patent
Henderson et al.

(10) Patent No.: US 9,241,534 B2
(45) Date of Patent: Jan. 26, 2016

(54) SHOE HAVING A SPLIT WELT

(71) Applicant: Cole Haan LLC, New York, NY (US)

(72) Inventors: Jeff Henderson, New York, NY (US); Salehe Bembury, New York, NY (US); Steve Beccia, New York, NY (US); TJ Papp, Interlaken, NJ (US)

(73) Assignee: Cole Haan LLC, New York, NY (US)

( * ) Notice: Subject to any disclaimer, the term of this patent is extended or adjusted under 35 U.S.C. 154(b) by 178 days.

(21) Appl. No.: 13/943,247

(22) Filed: Jul. 16, 2013

(65) Prior Publication Data

US 2014/0366400 A1 Dec. 18, 2014

(51) Int. Cl.
*A43B 9/06* (2006.01)
*A43B 9/04* (2006.01)

(52) U.S. Cl.
CPC .... *A43B 9/06* (2013.01); *A43B 9/04* (2013.01)

(58) Field of Classification Search
CPC ..... A43B 15/00; A43B 3/244; A43B 9/04; A43B 9/06; A43B 9/08; A43B 9/10
USPC ..... 36/87, 102, 17 R, 78, 17 A, 17 PW, 18, 36/19 R; D2/977
See application file for complete search history.

(56) References Cited

U.S. PATENT DOCUMENTS 1,756,169 A * 4/1930 Jaroslav ..... 36/17 R
2,195,476 A * 4/1940 Harold ..... A43B 9/06 36/17 R
4,450,632 A * 5/1984 Bensley ..... 36/17 PW
4,615,126 A * 10/1986 Mathews ..... A43B 5/06 36/102
5,408,761 A * 4/1995 Gazzano ..... A43B 5/00 36/102
6,205,604 B1 * 3/2001 Harkins, Sr. ..... 12/146 W
D513,861 S * 1/2006 Teteriatnikov ..... D2/977
7,836,609 B2 * 11/2010 Covatch ..... A43B 9/06 12/142 D
8,516,721 B2 * 8/2013 Mahoney ..... A43B 7/1425 36/102
2005/0072024 A1 * 4/2005 Chen et al. ..... A43B 7/141 36/12
2008/0244934 A1 * 10/2008 Covatch ..... 36/17 R
2010/0126039 A1 * 5/2010 McClaskie et al. ..... 36/12
2010/0313450 A1 * 12/2010 Morgan ..... 36/17 R
2011/0099852 A1 * 5/2011 Yen et al. ..... A43B 9/06 36/17 R
2011/0277350 A1 * 11/2011 Huynh ..... A43B 23/027 36/102
2012/0180339 A1 * 7/2012 Izquieta Anaut ..... A43B 23/027 36/102

* cited by examiner

*Primary Examiner* — Jila M Mohandesi
*Assistant Examiner* — Carolyn W Davis
(74) *Attorney, Agent, or Firm* — Thompson Coburn LLP

(57) ABSTRACT

A shoe comprises a sole, an upper, and a welt. The upper is operatively secured to the sole. The sole and upper define a seam. The seam has a seam toe region, a seam heel region, a seam lateral side region, a seam ball region, and a seam instep region. The welt is secured to at least one of the sole and the upper. The welt covers the seam toe region, the seam lateral side region, the seam heel region, and the seam instep region. The welt does not cover the seam ball region.

8 Claims, 4 Drawing Sheets

SHOE HAVING A SPLIT WELT

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND OF THE INVENTION

Field of the Invention

This invention pertains to shoes having welts.

SUMMARY OF THE INVENTION

One aspect of the invention is a shoe comprising a sole, an upper, and a welt. The sole comprises a sole heel region, a sole toe region, a sole lateral side region between the sole heel region and the sole toe region, and a sole medial side region between the sole heel region and the sole toe region. The sole medial side region includes a sole ball region and a sole instep region. The upper is operatively secured to the sole. The upper comprises an upper heel region, an upper toe region, an upper lateral side region between the upper heel region and the upper toe region, and an upper medial side region between the upper heel region and the upper toe region. The upper medial side region includes an upper ball region and an upper instep region. The upper heel region is adjacent sole heel region. The upper toe region is adjacent the sole toe region. The upper lateral side region is adjacent the sole lateral side region. The upper ball region is adjacent the sole ball region. The upper instep region is adjacent the sole instep region. The sole and upper define a seam. The seam has a seam toe region, a seam heel region, a seam lateral side region, a seam ball region, and a seam instep region. The seam toe region is adjacent both the upper toe region and the sole toe region. The seam heel region is adjacent both the upper heel region and the sole heel region. The seam lateral side region is adjacent both the upper lateral side region and the sole lateral side region. The seam ball region is adjacent the upper ball region and the sole ball region. The seam instep region is adjacent the upper instep region and the sole instep region. The welt is secured to at least one of the sole and the upper. The welt covers the seam toe region, the seam lateral side region, the seam heel region, and the seam instep region. The welt does not cover the seam ball region.

Further features and advantages of the present invention, as well as the operation of the invention, are described in detail below with reference to the accompanying drawings.

Figure 1:
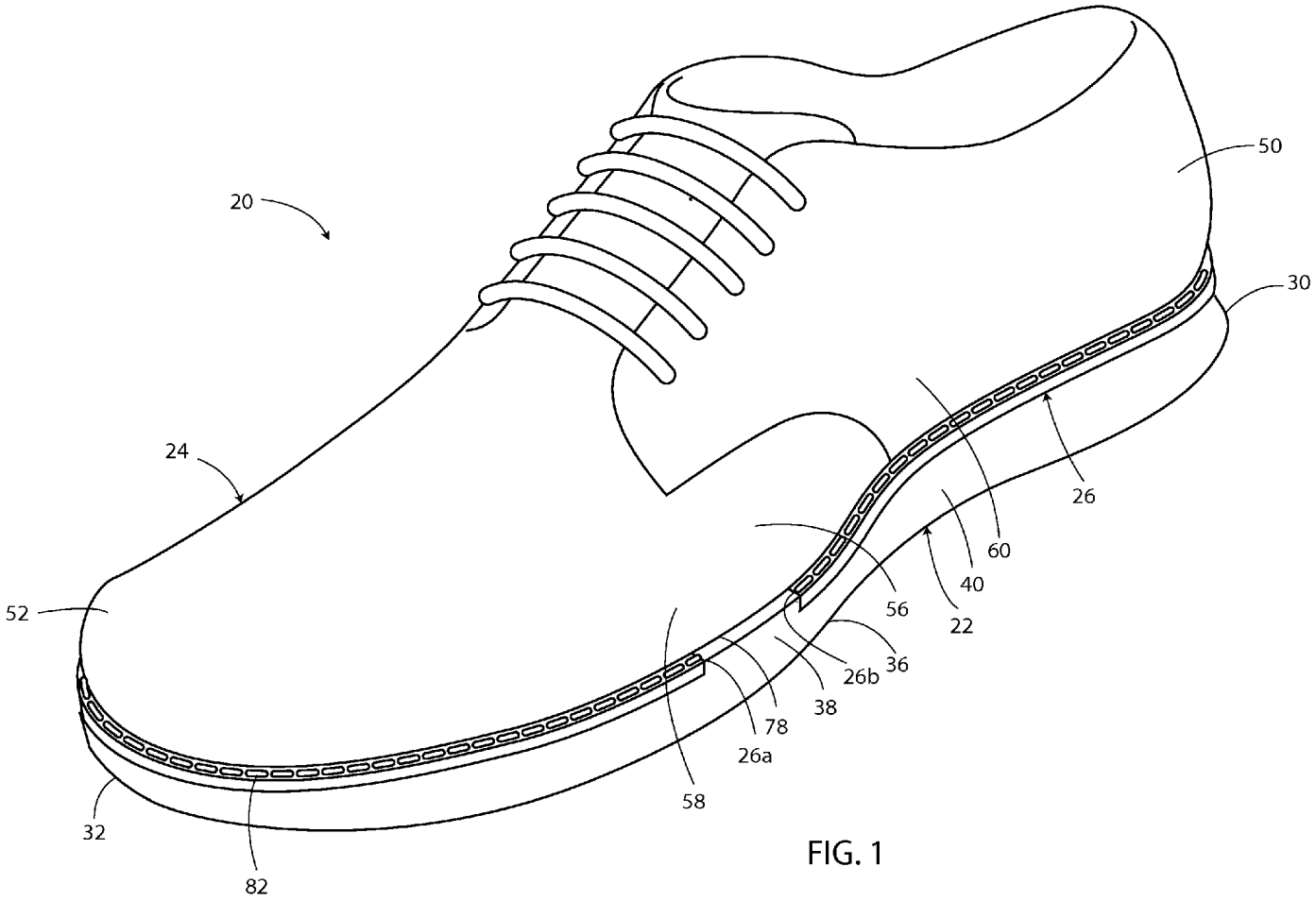
FIG. 1 is an isometric view of an embodiment of a shoe in accordance with the present invention, the shoe including a sole, an upper and a welt.
Figure 2:
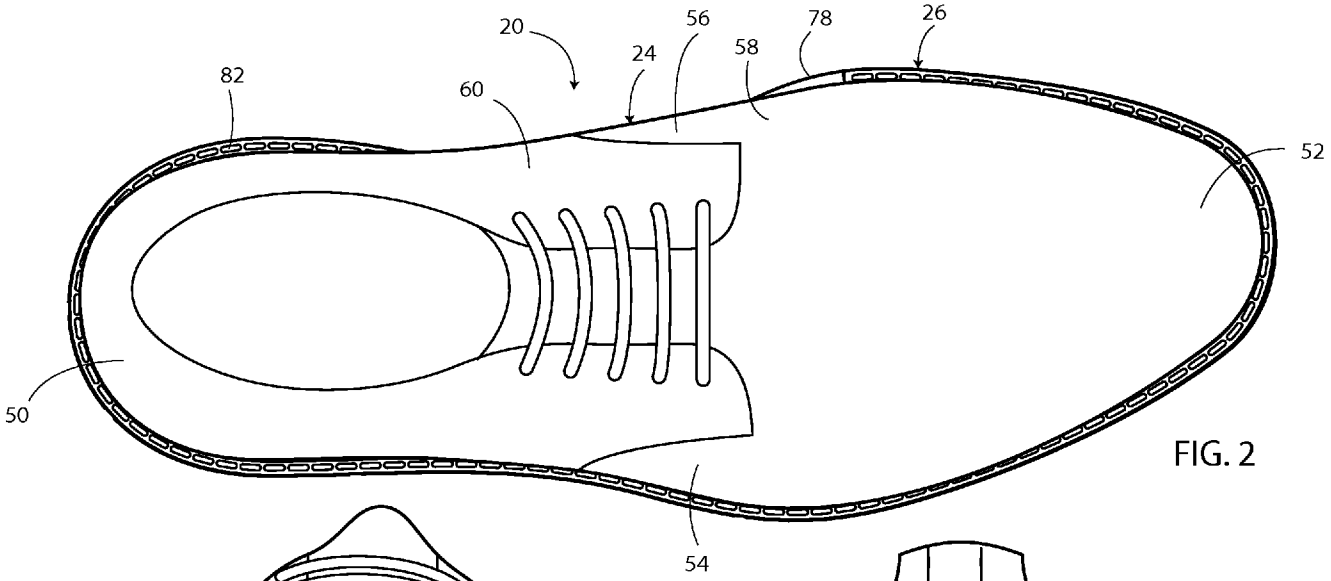
FIG. 2 is a top plan view of the shoe of FIG. 1.
Figure 6:
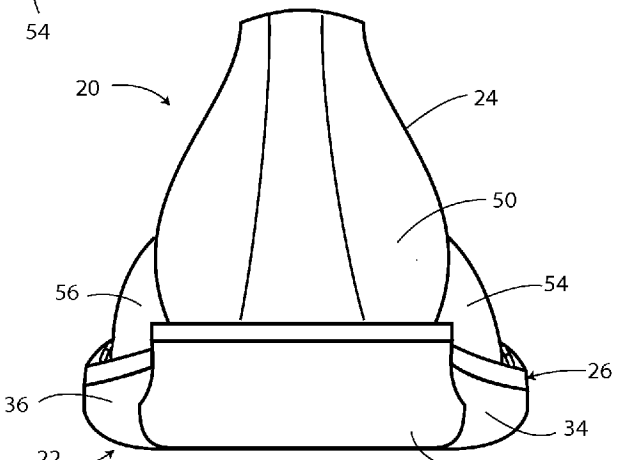
FIG. 6 is a rear elevation view of the shoe of FIG. 1.
Figure 5:
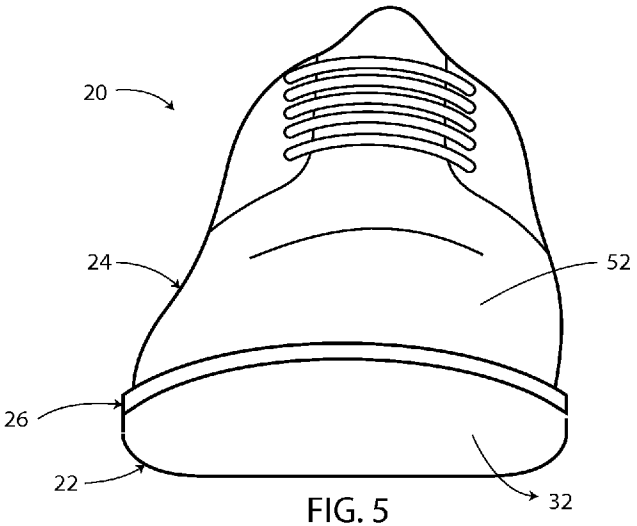
FIG. 5 is a front elevation view of the shoe of FIG. 1.

Reference numerals in the written specification and in the drawing figures indicate corresponding items.

DETAILED DESCRIPTION

An embodiment of a shoe in accordance with the present invention is indicated by reference numeral 20 in FIGS. 1-6. The shoe 20 comprises a sole, generally indicated at 22, an upper, generally indicated at 24, and a welt, generally indicated at 26.

The sole 22 comprises a sole heel region 30, a sole toe region 32, a sole lateral side region 34 between the sole heel region and the sole toe region, and a sole medial side region 36 between the sole heel region and the sole toe region. The sole medial side region 36 includes a sole ball region 38 and a sole instep region 40. The sole 22 is preferably of ethylene-vinyl acetate (EVA), but may be of any suitable sole material, such as leather, polyurethane or some other suitable polymer, combinations thereof, etc.

The upper 24 is operatively secured to the sole 22. Preferably, the upper is directly secured to the sole 22 via adhesive. The upper 24 comprises an upper heel region 50, an upper toe region 52, an upper lateral side region 54 between the upper heel region and the upper toe region, and an upper medial side region 56 between the upper heel region and the upper toe region. The upper medial side region 56 includes an upper ball region 58 and an upper instep region 60. The upper heel region 50 is adjacent sole heel region 30. The upper toe region 52 is adjacent the sole toe region 32. The upper lateral side region 54 is adjacent the sole lateral side region 34. The upper ball region 58 is adjacent the sole ball region 38. The upper instep region 60 is adjacent the sole instep region 40. The upper may be a slip-on type upper or a lace-up type upper. The upper could be a loafer, an oxford, a moccasin, or other suitable type.

Figure 3:
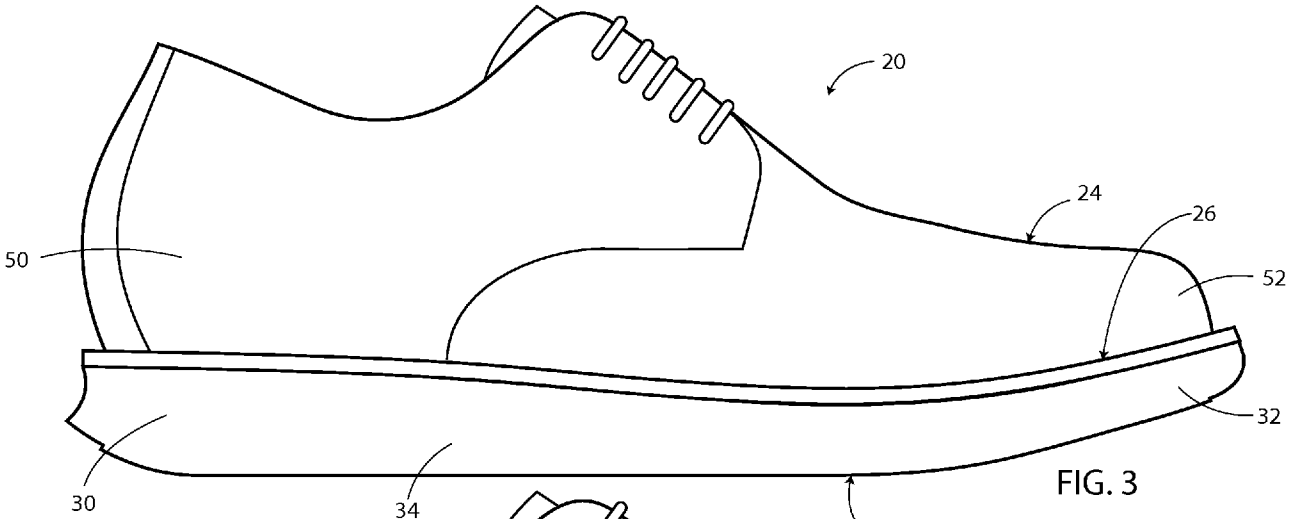
FIG. 3 is a lateral side elevation view of the shoe of FIG. 1.
Figure 3A:
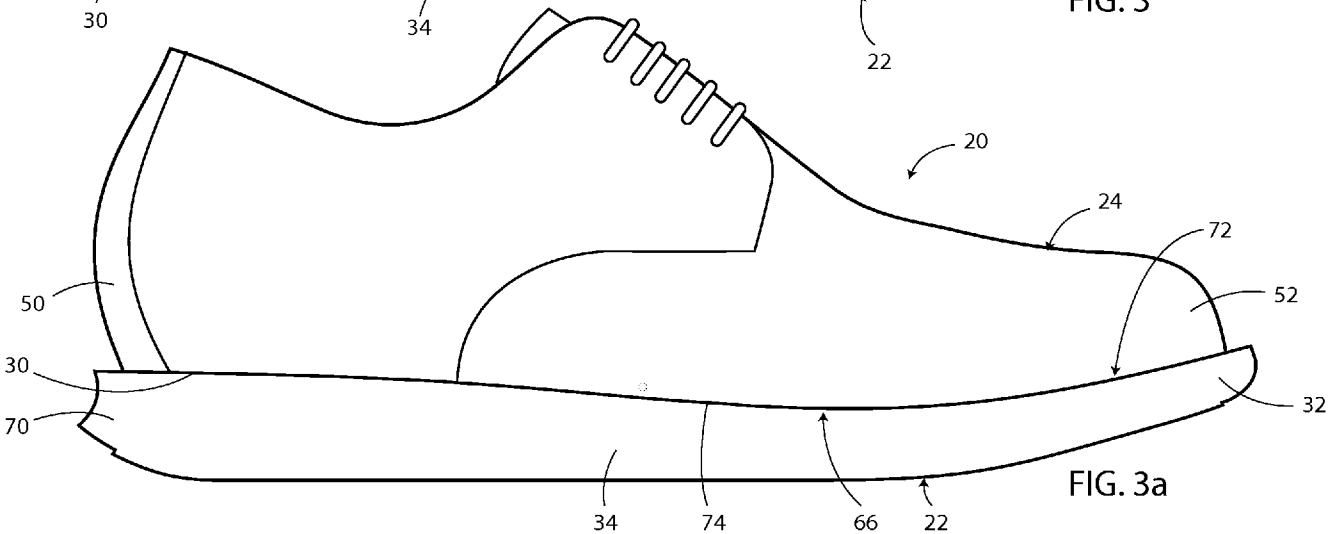
FIG. 3*a* is a lateral side elevation view of the shoe of FIG. 1, similar to the view of FIG. 3 but without showing the welt.
Figure 4:
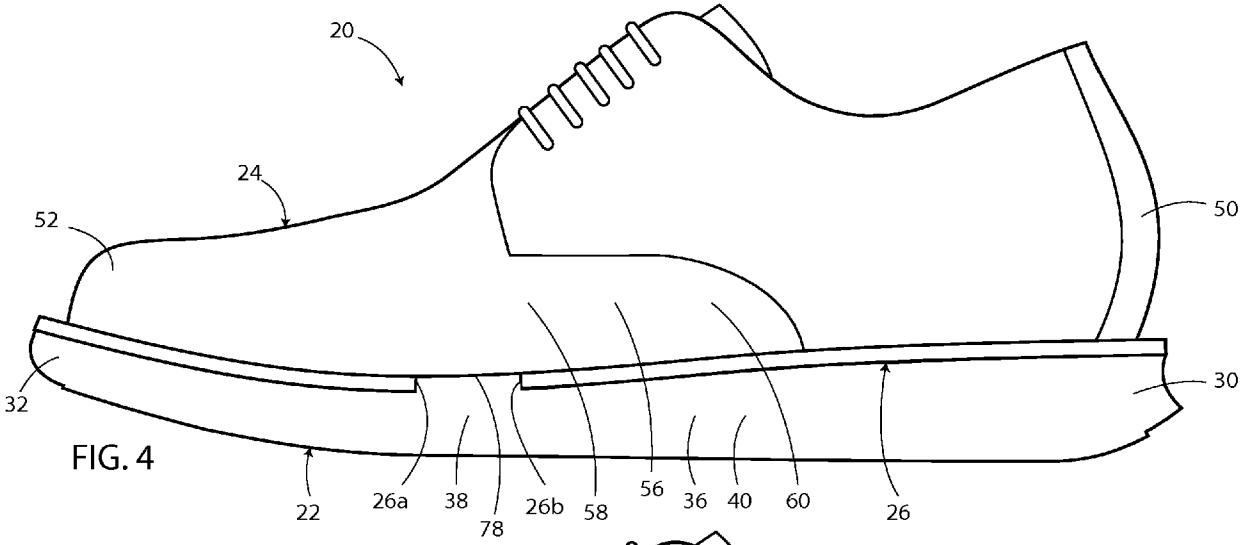
FIG. 4 is a medial side elevation view of the shoe of FIG. 1.
Figure 4A:
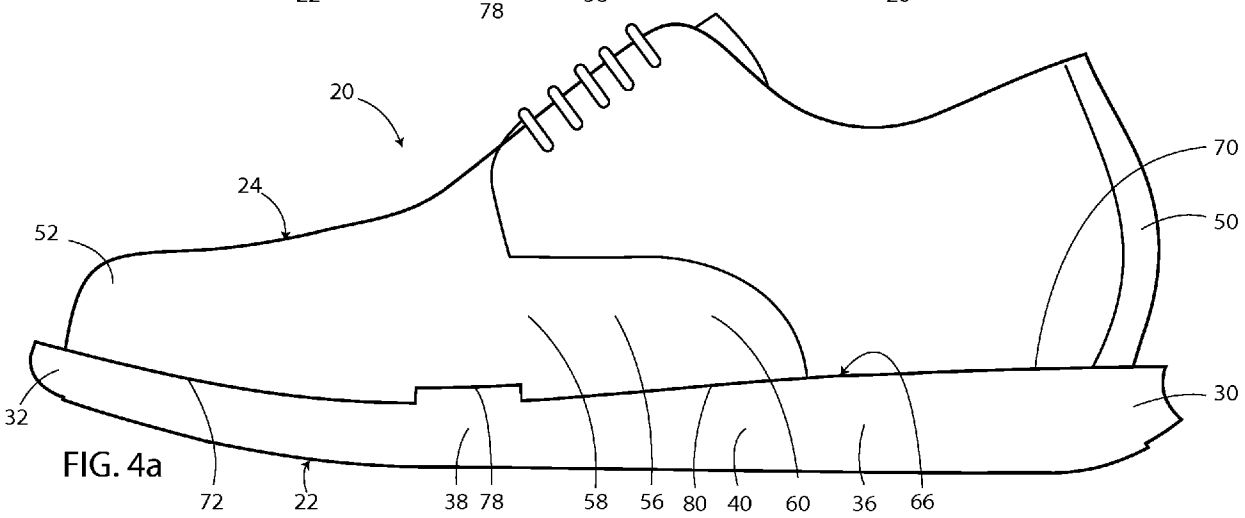
FIG. 4*a* is a medial side elevation view of the shoe of FIG. 1, similar to the view of FIG. 4 but without showing the welt.

Referring now to FIGS. 3*a* and 4*a*, the sole 22 and upper 24 define a seam, generally indicated at 66. The seam 66 comprises the combination of a bottom region of the upper 24 and a top region of the sole 22. The seam 66 has a seam heel region 70, a seam toe region 72, a seam lateral side region 74, a seam ball region 78, and a seam instep region 80. The seam heel region 70 is adjacent both the upper heel region 50 and the sole heel region 30. The seam toe region 72 is adjacent both the upper toe region 52 and the sole toe region 32. The seam lateral side region 74 is adjacent both the upper lateral side region 54 and the sole lateral side region 34. The seam ball region 78 is adjacent the upper ball region 58 and the sole ball region 38. The seam instep region 80 is adjacent the upper instep region 60 and the sole instep region 40. The welt 26 is secured to at least one of the sole 22 and the upper 24. The welt 26 covers the seam toe region 72, the seam lateral side region 74, the seam heel region 70, and the seam instep region 80. The welt 26 does not cover the seam ball region 78. The seam ball region is devoid of welt material. In the present embodiment, the seam ball region 78 is exposed (see FIGS. 1, 2 and 4). In other words, in the finished shoe 20, the seam ball region 78 is visible. Preferably the welt 26 is a unitary one-piece member traversing in a continuous manner along the bottom periphery of the upper 24 and traversing in a continuous manner along the top periphery of the sole 22. But it should be understood that the welt 26 does not completely circumscribe the entire bottom periphery of the upper 24 and does not completely circumscribe the entire top periphery of the sole 22. The welt 26 includes a first end 26a and a second end 26b. Because the welt 26 does not completely circumscribe the bottom periphery of the upper 24 and the top periphery of the sole 22, the first end 26*a* of the welt is spaced from the second end 26*b*. In particular, the seam ball region 78 is generally between the first and second ends 26*a*, 26*b* of the welt 26.

Preferably, the welt 26 is stitched to the sole 22 via a thread 82. Alternatively or in addition, the welt may be stitched or otherwise secured to the upper 24. Preferably, the welt 26 is of a material stiffer than the material of the sole 22. Preferably, the welt is of leather. The absence of welt material in the vicinity of the seam ball region 78 provides greater flexibility of the shoe 20 in the ball region, i.e., the region of the shoe adjacent the ball of the user's foot when the user is wearing the shoe.

In view of the foregoing, it should be appreciated that the invention has several advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents. While the bottom region of the upper 24 and the top region of the sole 22 are preferably in contact with one another, it is to be understood that other constructions of shoes may be employed without departing from the scope of the invention. For example, a shoe construction in which the bottom region of the upper 24 is spaced from the top region of the sole by a portion of the welt or by some other member still includes a seam as the term seam is used herein.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

What is claimed is:

1. A shoe comprising:

a sole comprising a sole heel region, a sole toe region, a sole lateral side region between the sole heel region and the sole toe region, and a sole medial side region between the sole heel region and the sole toe region, the sole medial side region including a sole ball region and a sole instep region;

an upper operatively secured to the sole, the upper comprising an upper heel region, an upper toe region, an upper lateral side region between the upper heel region and the upper toe region, and an upper medial side region between the upper heel region and the upper toe region, the upper medial side region including an upper ball region and an upper instep region, the upper heel region being adjacent sole heel region, the upper toe region being adjacent the sole toe region, the upper lateral side region being adjacent the sole lateral side region, the upper ball region being adjacent the sole ball region, and the upper instep region being adjacent the sole instep region; and a welt having a first end and a second end, the welt being a single one-piece member extending in a continuous manner from the first end to the second end;

the sole and upper defining a seam, the seam having a seam toe region adjacent both the upper toe region and the sole toe region, a seam heel region adjacent both the upper heel region and the sole heel region, a seam lateral side region adjacent both the upper lateral side region and the sole lateral side region, a seam ball region adjacent the upper ball region and the sole ball region, and a seam instep region adjacent the upper instep region and the sole instep region;

the welt being secured to at least one of the sole and the upper, the welt covering the seam toe region, the seam lateral side region, the seam heel region, and the seam instep region, the welt not covering the seam ball region.

2. A shoe as set forth in claim 1 wherein the seam ball region is generally between the first and second ends of the welts.

3. A shoe as set forth in claim 2 wherein the welt is stitched to the sole.

4. A shoe as set forth in claim 2 wherein the welt is of a first material and the sole is of a second material, the first and second materials being different.

5. A shoe as set forth in claim 4 wherein the sole comprises a polymeric material.

6. A shoe as set forth in claim 4 wherein the sole comprises a polyurethane material.

7. A shoe as set forth in claim 4 wherein the welt is of leather.

8. A shoe as set forth in claim 4 wherein the sole comprises an EVA material.

* * * * *